US005454660A

United States Patent [19]

Sakurai et al.

[11] Patent Number: 5,454,660

[45] Date of Patent: Oct. 3, 1995

[54] APPLICATOR HAVING A POROUS MEMBRANE WITH APERTURE

[75] Inventors: Kiyokazu Sakurai; Takashi Umeno; Nobuyuki Nakajima, all of Fujioka, Japan

[73] Assignee: Mitsubishi Pencil Co., Ltd., Tokyo, Japan

[21] Appl. No.: 177,513

[22] Filed: Jan. 4, 1994

[30] Foreign Application Priority Data

Apr. 23, 1993 [JP] Japan ..... 5-026813 U

[51] Int. Cl.[6] ..... A45D 40/06; A45D 40/04; A45D 40/20

[52] U.S. Cl. ..... 401/266; 401/174; 401/205; 401/207; 401/263

[58] Field of Search ..... 401/266, 174, 401/262, 263, 261, 265, 205, 207

[56] References Cited

U.S. PATENT DOCUMENTS

| | | | |
|---|---|---|---|
| 1,968,686 | 7/1934 | Janer | 401/266 X |
| 2,724,850 | 11/1955 | Howard et al. | 15/124 |
| 2,948,008 | 8/1960 | Leeds et al. | 401/266 X |
| 2,962,743 | 12/1960 | Henriksson | 401/266 |
| 3,010,138 | 11/1961 | Nadai | 15/515 |
| 4,002,182 | 1/1977 | Michel | 401/266 X |
| 4,889,441 | 12/1989 | Tice | 401/131 |

FOREIGN PATENT DOCUMENTS

| | | |
|---|---|---|
| 2030798 | 11/1970 | France . |
| 2606675 | 5/1988 | France . |
| 2645724 | 10/1990 | France . |
| 2656202 | 6/1991 | France . |
| 629579 | 1/1987 | Japan . |
| 3109678 | 11/1991 | Japan . |
| 480409 | 7/1992 | Japan . |
| 507134 | 5/1971 | Switzerland . |
| 1284369 | 8/1972 | United Kingdom . |
| 2197783 | 6/1988 | United Kingdom . |
| 2240033 | 7/1991 | United Kingdom . |
| 2249948 | 5/1992 | United Kingdom . |
| WO86/01085 | 2/1986 | WIPO . |

*Primary Examiner*—Steven A. Bratlie
*Attorney, Agent, or Firm*—Foley & Lardner

[57] ABSTRACT

An applicator for applying a fluid such as eye shadow. The applicator comprises a tubular core having a conduit, and a porous outer membrane arranged to cover the tip of the tubular core. The outlet of the conduit, of the tubular core is formed so that the outlet opens in the tubular core on one side of the tubular core from the longitudinal axis of the tubular core. Therefore, it is possible to apply a fluid to a surface, such a skin of a human being, by using one side of the applicator through which the fluid easily soaks, and to spread and gradate the fluid on the surface, by using the other side of the applicator. The outer membrane may be made from two or three porous sheet members having different porosities from each other, so that a fluid easily soaks through one of the porous sheet members having a relatively large porosity.

27 Claims, 21 Drawing Sheets

APPLICATOR HAVING A POROUS MEMBRANE WITH APERTURE

BACKGROUND OF THE INVENTION

1. Field of the Invention

The present invention relates to an applicator for applying a fluid, for example, a fluid cosmetic such as a liquid eye shadow.

2. Description of the Related Art

A known applicator for applying a fluid comprises a tubular core for introducing a fluid from a reservoir and discharging the fluid from an outlet arranged at the distal end of the applicator, and an elastic porous outer membrane, such as urethane foam permeable to a fluid, in the shape of a bag, covering the tip portion of the tubular core. In the conventional applicator, a fluid uniformly soaks through the substantially entire area of the outer membrane. In an actual operation for applying a cosmetic to a skin of a human being, it is necessary to spread and gradate the cosmetic after the cosmetic is applied to the skin. The conventional applicator is not adapted to carry out these operations because a fluid uniformly soaks through the substantially entire area of the outer membrane, and it is disadvantageous and inevitable that a finger or a brush or something else must be used for spreading and graduating the cosmetic.

SUMMARY OF THE INVENTION

The object of the present invention is to provide an applicator for applying a fluid, which can be used not only for applying a fluid to a surface but for spreading and graduating the fluid on the surface.

According to the present invention, there is provided an applicator for applying a fluid comprising a tubular core having a longitudinal axis and a conduit extending along the longitudinal axis. The conduit having an inlet adapted to receive a fluid and an outlet. A porous outer membrane permeable to a fluid is arranged to cover at least a portion of the tubular core. The covered portion of the tubular core includes the outlet of the conduit, wherein the outlet of the conduit of the tubular core is formed so that the outlet opens in the tubular core on one side of the tubular core from the longitudinal axis.

In this arrangement, the fluid mainly soaks through one side of the elastic outer membrane, since the outlet of the conduit opens on one side of the tubular core. Therefore, it is possible to apply a fluid to a surface, such as a skin of a human being, by using one side of the applicator through which the fluid easily soaks, and to then spread and gradate the fluid on the surface, by using the other side of the applicator through which the fluid does not soak well.

Preferably, a recess is arranged in the conduit of the tubular core near the outlet for holding a fluid therein.

Preferably, the tubular core is formed in a generally oval cross-section having a pair of opposite larger curvature portions and a pair of opposite smaller curvature portions between the larger curvature portions, and the outlet of the conduit opens to one of the larger curvature portions.

Preferably, the applicator comprises a barrel having a reservoir adapted to contain a fluid therein, and the tubular core is attached to the barrel so that the inlet of the conduit receives a fluid in the reservoir. A piston is arranged in the reservoir of the barrel, and actuating means is provided for actuating the piston to discharge a fluid in the reservoir through the conduit of the tubular core. Preferably, the actuating means comprise a manually operable member which can be rotatably operated to push the piston. Ratchet means are preferably provided to allow the manually operable member to rotate in one direction only.

Preferably, the barrel comprises a main barrel and an end barrel attached to the main barrel, the tubular core being attached to the main barrel with the end barrel enclosing the tubular core so that a portion of the outer membrane covering the outlet of the conduit projects from the end barrel.

Preferably, the outer membrane is pinched between the tubular core and the end barrel.

In this case, the tubular core has an externally projecting annular shoulder, and the end barrel has an internally projecting annular shoulder arranged in the opposite sense to the externally projecting annular shoulder of the tubular core, whereby the outer membrane can be pinched by the externally projecting annular shoulder of the tubular core and the internally projecting annular shoulder of the end barrel.

In addition to the externally and internally projecting annular shoulders, or independently of the shoulders, it is preferable that the tubular core has at least one external annular projection, and the end barrel has at least one internal annular projection at a position axially offset from the at least one external annular projection; or the tubular core has at least one external annular projection, and the end barrel has at least one internal annular projection at a position axially overlapping the at least one external annular projection. By these shoulders and/or projections, the outer membrane can be more reliably fastened to the tubular core without other fastening means.

Preferably, the outer membrane comprises at least two porous sheet members having different porosities from each other. One of the at least two porous sheet members having a larger porosity is arranged to cover the outlet, and the other porous sheet member is arranged on the other side of the outer membrane. Alternatively, the outer membrane comprises three porous sheet members, the first of three porous sheet members is arranged on said one side of the outer membrane to cover the outlet, and the second and the third of three porous sheet members are arranged on the other side of the outer membrane with the third porous sheet member covering the second porous sheet member, the third porous sheet member having the smallest porosity.

Preferably, the outer membrane has a small aperture on one side of the outer membrane corresponding to the side of the tubular core where the outlet is formed, to assist the soaking of the fluid through the outer membrane.

In another aspect of the present invention, an applicator for applying a fluid comprises a tubular core having a longitudinal axis and a conduit extending along the longitudinal axis, the conduit having an inlet adapted to receive a fluid and an outlet, and a porous outer membrane permeable to a fluid and covering at least a portion of the tubular core including the outlet of the conduit, the porous outer membrane comprising at least two porous sheet members having different porosities from each other, one of the at least two porous sheet members having a larger porosity being arranged on one side of the outer membrane from the longitudinal axis of the tubular core, the other porous sheet member being arranged on the other side of the outer membrane.

In a further aspect of the present invention, an applicator for applying a fluid comprises a tubular core having a longitudinal axis and a conduit extending along the longitudinal axis, the conduit having an inlet adapted to receive a fluid and an outlet, and a porous outer membrane permeable to a fluid and arranged to cover at least a portion of the tubular core including the outlet of the conduit, the outer membrane having a small aperture on one side of the outer membrane from the longitudinal axis of the tubular core.

In these cases too, it is possible to apply a fluid to a surface, by using one side of the applicator through which the fluid easily soaks, and to spread and gradate the fluid on the surface, by using the other side of the applicator where the fluid does not substantially soak.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
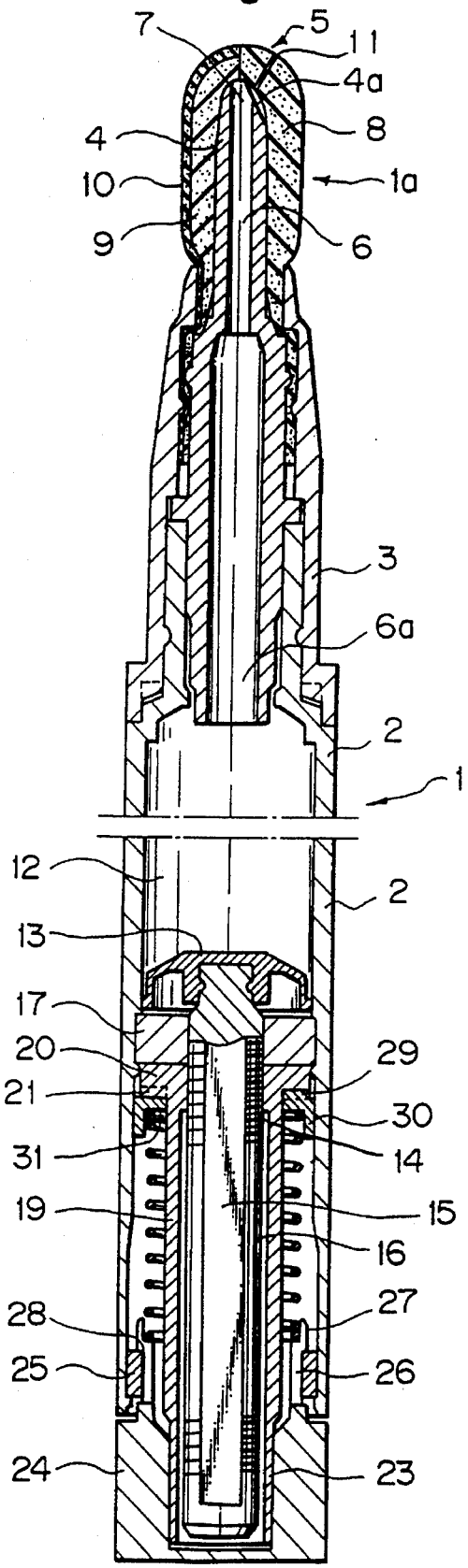
FIG. 1 is a cross-sectional view of the applicator according to the first embodiment of the present invention.
Figure 2:
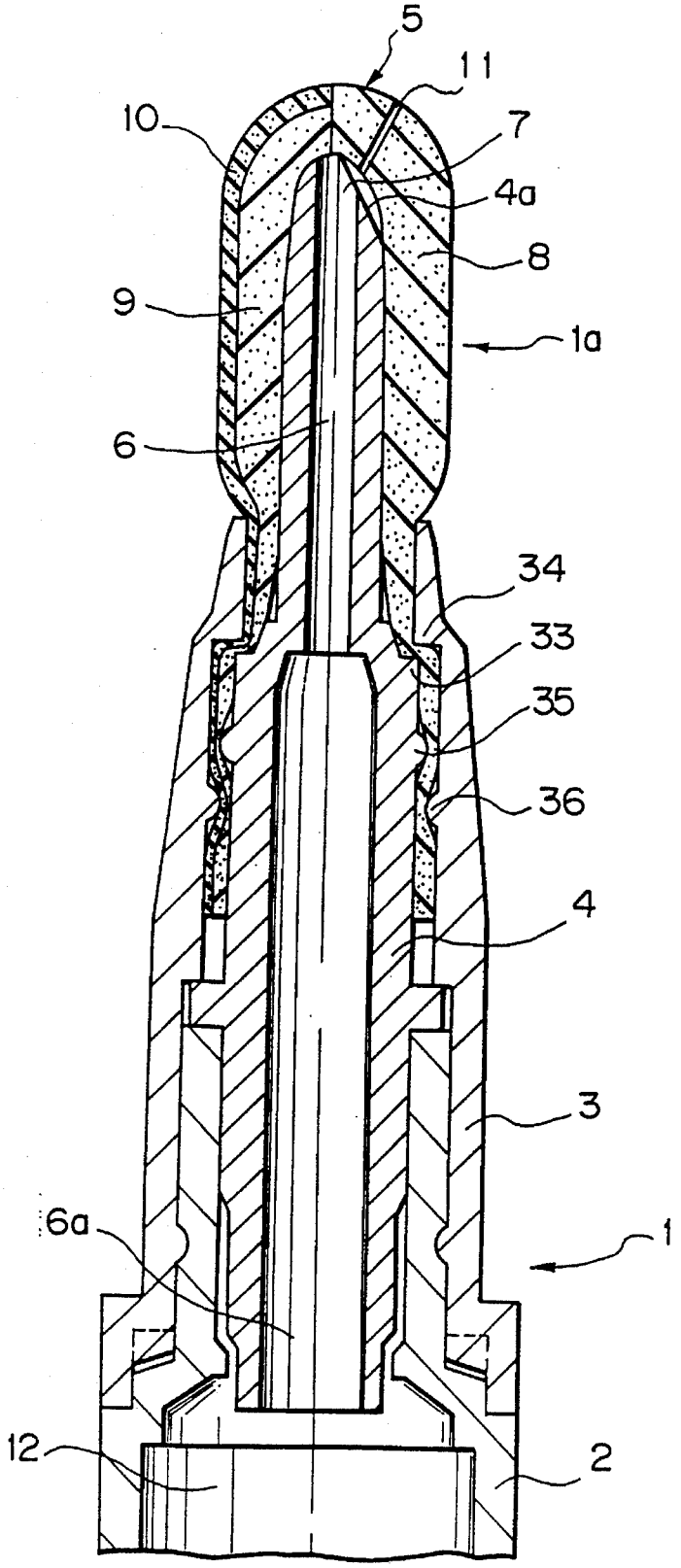
FIG. 2 is an enlarged cross-sectional view of a portion of the applicator of FIG. 2.
Figure 3:
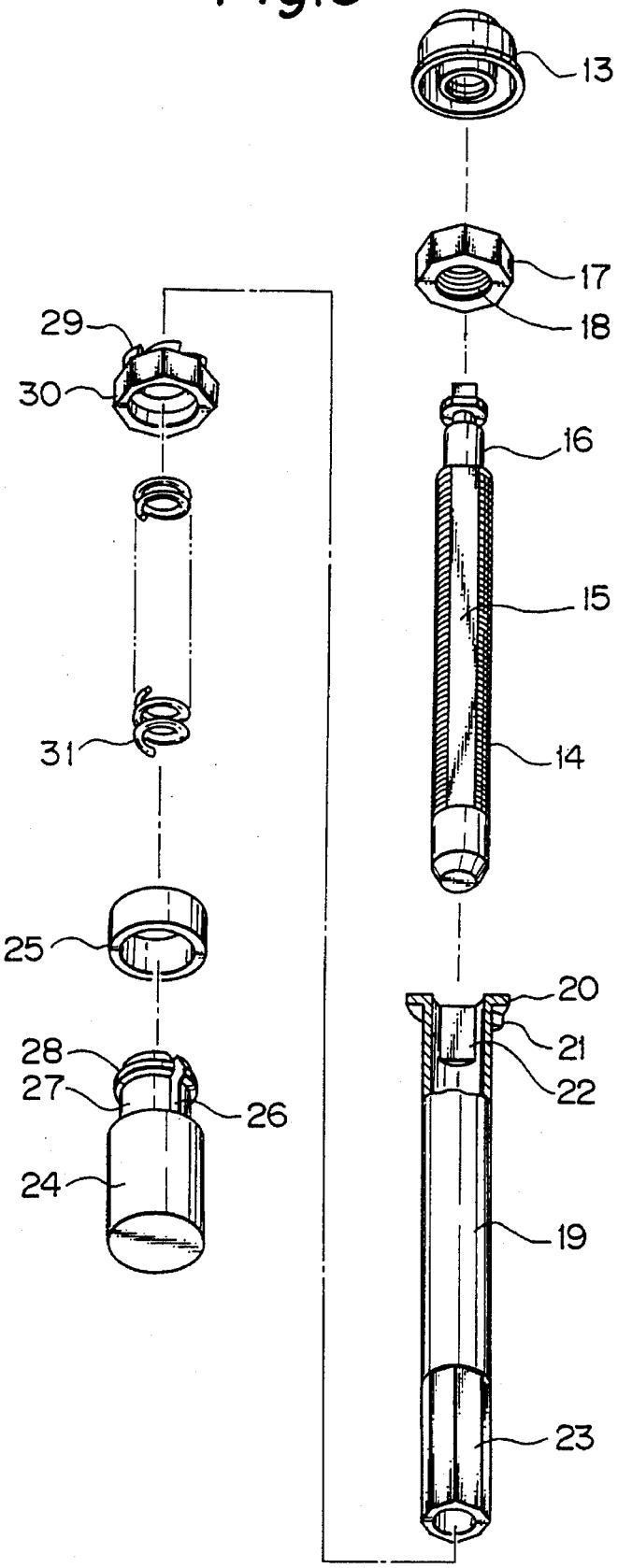
FIG. 3 is an exploded perspective view of the barrel of the applicator and elements housed in the barrel of FIGS. 1 and 2.
Figure 4:
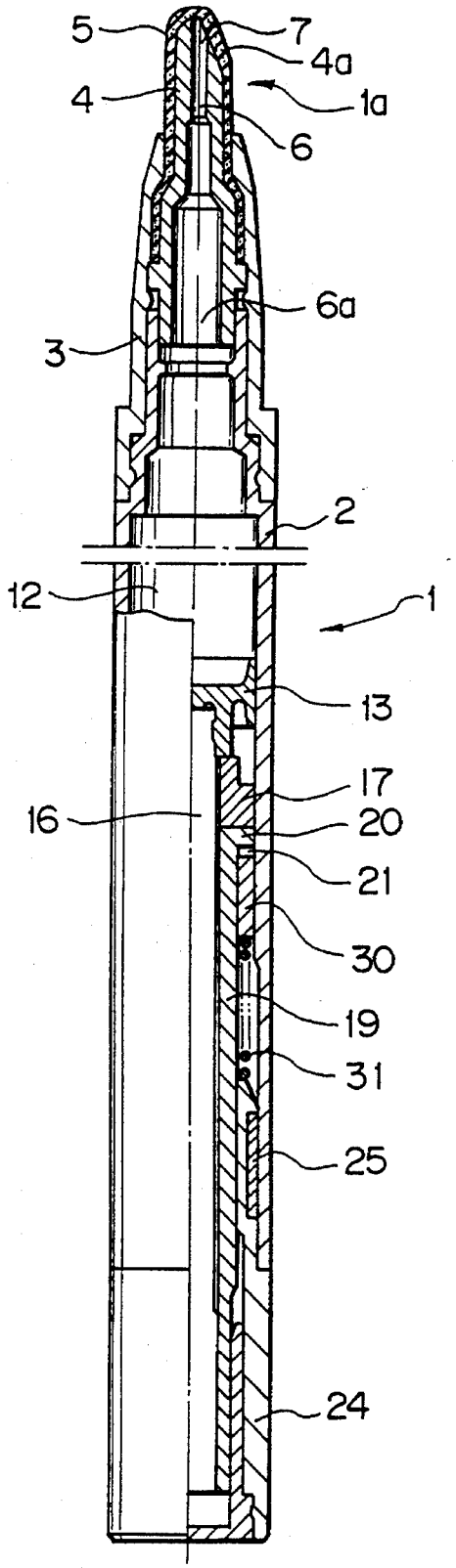
FIG. 4 is a cross-sectional view of the applicator according to the second embodiment of the present invention.

FIGS. 1 to 3 show the applicator 1 having an end portion la for applying a fluid according to the first embodiment of the present invention. As shown in FIGS. 1 and 2, the applicator 1 comprises a barrel including a main barrel 2 having a reservoir 12 for containing a fluid such as cream eye shadow therein, and an end barrel 3 firmly secured by the main barrel 2.

The end portion 1*a* of the applicator 1 comprises a tubular core 4 having a conduit 6 extending along the longitudinal axis of the tubular core 4, and an elastic porous outer membrane 5 covering the tip of the tubular core 4 of the tubular core 4. The tubular core 4 has an inlet 6*a* and an outlet 7, and is attached to the main barrel 2 so that the inlet 6*a* of the conduit 6 receives a fluid in the reservoir 12. The end barrel 3 encloses the outer membrane 5 so that the tip of the outer membrane 5 projects from the end barrel 3. It is possible to detachably arrange a cap (not shown) on the end barrel 3 to protect the outer membrane 5.

The tubular core 4 has a tip in a generally rounded shape. The tip of the tubular core 4 is cut out along a plane 4*a* inclined to the longitudinal axis of the tubular core 4, so that the outlet 7 of the conduit 6 opens on one side of the tubular core 4 from the longitudinal axis thereof.

The outer membrane 5 is made from a porous material in the form of a bag. The outer membrane 5 comprises three porous sheet members 8 to 10. The first porous sheet member 8 comprises a urethane foam having a relatively large porosity and constitutes one half of the outer membrane 5 arranged on one side of the outer membrane 5 so as to cover the outlet 7 of the conduit 6 of the tubular core 4. The third porous sheet member 10 covers or overlaps the second porous sheet member 9, and the second and third porous sheet members 9 and 10 constitute one half of the outer membrane 5 arranged on the other side of the outer membrane 5. The second porous sheet member 9 comprises a urethane foam having a porosity generally identical to that of the first porous sheet member 8. The third porous sheet member 10 comprises a urethane foam having a relatively small porosity, and thus a high density so that fluid does not easily soak through the third porous sheet member 10. The third porous sheet member 10 is adhered to the second porous sheet member 9 by heating and welding adjoining portions of the second and third porous sheet members 9 and 10 together. The first porous sheet member 8 is adhered to the second and third porous sheet members 9 and 10 by heating and welding adjoining portions thereof together. In addition, the first porous sheet member 8, which allows a fluid to soak therethrough bears a different color from the color of the third porous sheet member 10, which does not allow a fluid to soak therethrough, so that a user can visually recognize one from the other. For example, the first porous sheet member 8 is colored black, and the third porous sheet member 10 is colored white.

The three porous sheet members 8 to 10 are made from the same kind of material in this embodiment, but it is possible to make the three porous sheet members 8 to 10 from different materials other than a urethane foam. For example, silicone sponge, NBR sponge, non-woven fabric, felt, woven fabric and paper can be used for the porous sheet members 8 to 10.

The outer membrane 5 can be formed from a plurality of porous sheet members 8 to 10 having different porosities, as described above, but it is possible to form the outer membrane 5 from a single porous material through which a fluid can soak. When the outer membrane 5 is formed from a plurality of porous sheet members, it is not necessary that a material for the third porous sheet member 10 is more permeable than the first and second porous sheet members 8 and 9.

A small aperture 11 is provided in the first porous sheet member 8 of the outer membrane 5 so that a fluid can soak through the first porous sheet member 8 via the small aperture 11. The small aperture 11 opens toward the outlet 7 of the conduit 6. The small aperture 11 can be provided by piercing a pin in the first porous sheet member 8 to break a portion of the member 8 to form a hole. The hole can be formed by piercing a hot pin in the first porous sheet member 8 to dissolve a portion of the member 8, or by cutting a slit in the outer membrane 5 by a cutter edge. Accordingly, a fluid can soak through both the small aperture 11 and the porous wall of the first porous sheet member 8 of the outer membrane 5. A fluid can soak through the small aperture 11 when the porous wall of the first porous sheet member 8 of the outer membrane 5 is clogged.

The outer membrane 5 is pinched between the tubular core 4 and the end barrel 3. In particular, the tubular core 4 has an externally projecting annular shoulder 33, and the end barrel 3 has an internally projecting annular shoulder 34 arranged in the opposite sense to the externally projecting annular shoulder 33 of the tubular core 4, i.e., the internally projecting annular shoulder 34 faces the externally projecting annular shoulder 33 with a small gap between the edge of the internally projecting annular shoulder 34 and the edge of the externally projecting annular shoulder 33, as shown in FIG. 2. The outer membrane 5 can be thus pinched by the externally projecting annular shoulder 33 of the tubular core 4 and the internally projecting annular shoulder 34 of the end barrel 2 between the edges thereof.

In addition, the tubular core 4 has an external annular projection 35, and the end barrel 3 has an internal annular projection 36 at a position axially offset from the external annular projection 35. Thus, the outer membrane 5 can be reliably fastened to the tubular core 4 without other fastening means.

Figure 31:
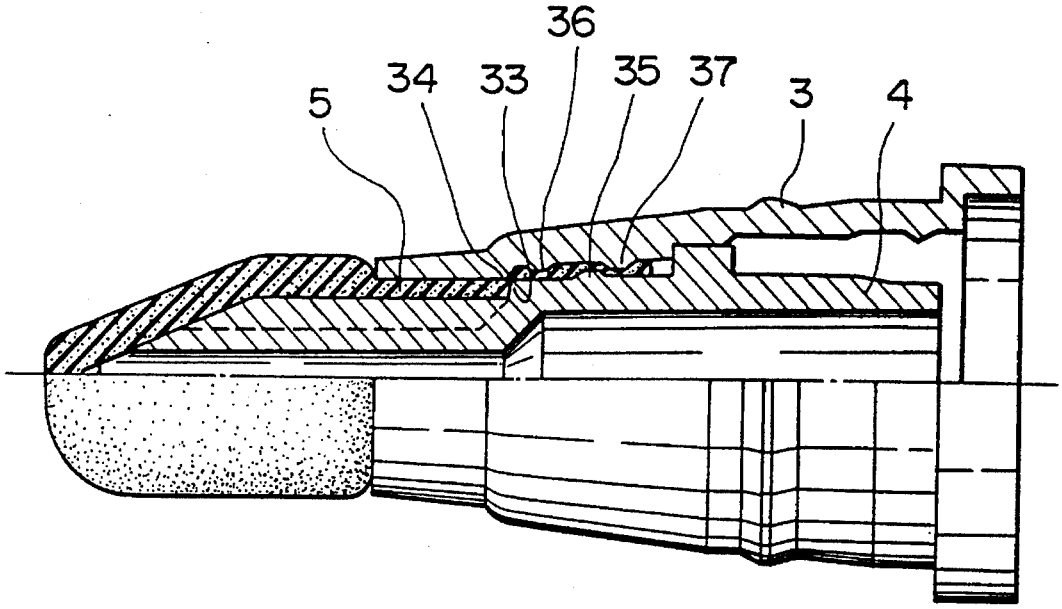
FIG. 31 is a cross-sectional view of a portion of the modified applicator, including means for fastening the outer membrane to the tubular core.
Figure 32:
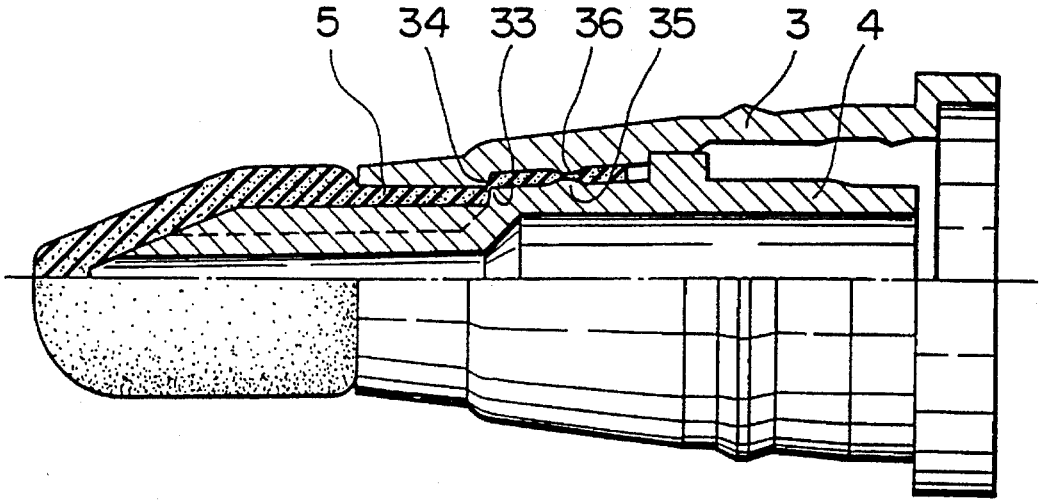
FIG. 32 is a cross-sectional view of a portion of the modified applicator.
Figure 33:
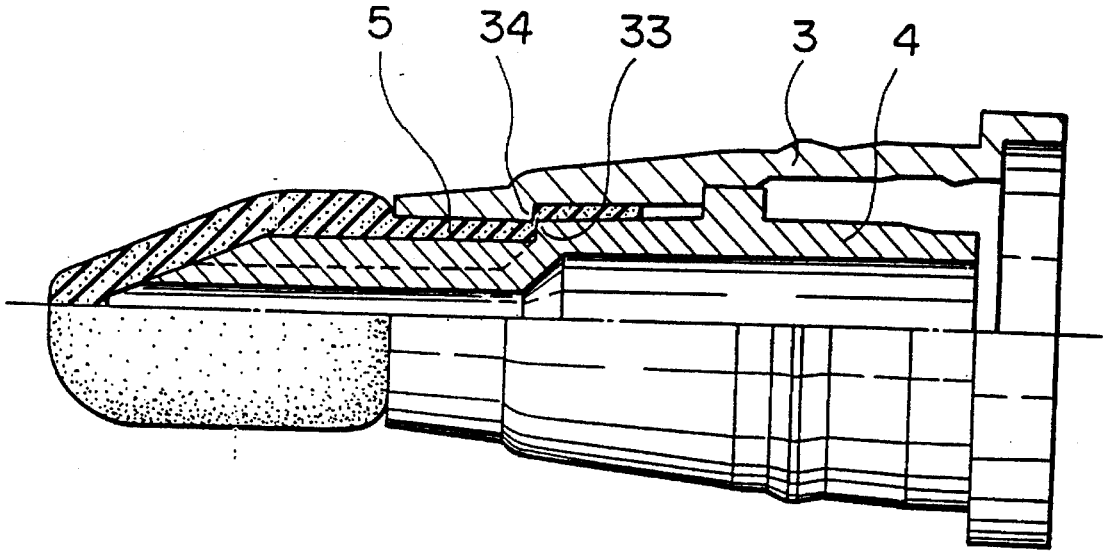
FIG. 33 is a cross-sectional view of a portion of the modified applicator.

Modifications of the shoulders and/or the projections are shown in FIG. 31 to 33. In FIG. 31, the tubular core 4 has an externally projecting annular shoulder 33, and the end barrel 3 has an internally projecting annular shoulder 34. Also, the tubular core 4 has an external annular projection 35, and the end barrel 3 has internal annular projections 36 and 37 so that the outer membrane 5 is thus pinched in a wavy position.

In FIG. 32, the tubular core 4 has an externally projecting annular shoulder 33, and the end barrel 3 has an internally projecting annular shoulder 34. Also, the tubular core 4 has an external annular projection 35, and the end barrel 3 has an internal annular projection 36 at a position axially overlapping the external annular projection 35.

In FIG. 33, the tubular core 4 has an externally projecting annular shoulder 33, and the end barrel 3 has an internally projecting annular shoulder 34 to pinch the outer membrane 5 therebetween.

Referring to FIGS. 1 and 3, a piston 13 is slidably arranged in the reservoir 12 of the main barrel 2, and a rod 16 is connected to the rear of the piston 13. The rod 16 has a male thread 14 along the length thereof and a pair of flat surfaces 15. A nut-like support element 17 having a female thread 18 is arranged in the main barrel 2, the support element 17 being axially and rotationally immovable. The rod 16 is inserted in the support element 17 with the male thread 14 engaging with the female thread 18. Accordingly, the rod 16 with the piston 13 advances in the main barrel 2 to discharge a fluid in the reservoir 12 through the conduit 6 of the tubular core 4 when the rod 16 is rotated.

A rotatable hollow actuating rod 19 is inserted in the main barrel 2 and over the rod 16. The actuating rod 19 has a flange 20 at the front end of the actuating rod 19, a ratchet 21 on the rear surface of the flange 20, a pair of inner flat surfaces 22 for engagement with the flat surfaces 15 of the rod 16 for conjoint rotation of the actuating rod 19 and the rod 16, and an outer polygonal profile 23.

A manually operable tail cap 24 is attached to the rear end of the main barrel 2, the tail cap 24 having an inner polygonal profile adapted to fit on the outer polygonal profile 23 of the actuating rod 19 for conjoint rotation of the tail cap 24 and the actuating rod 19. The tail cap 24 has a split ring portion 27 with slits 26, and a flange 28 at the front end of the split ring portion 27. The split ring portion 27 is elastically forced into a retaining ring 25 fixed in the main barrel 2. The flange 28 engages the inner edge of the retaining ring 25 to retain the tail cap 24 to the main barrel 2 while allowing the rotation of the tail cap 24 relative to the main barrel 2.

A nut-like spring support 30 is inserted in the main barrel and over the actuating rod 19, and a spring 31 is arranged between the spring support 30 and the retaining ring 25. The spring support 30 is rotationally immovable but axially movable. The spring support 30 is urged toward the flange 20 of the actuating rod 19 by the spring 31, and has a ratchet 29 which cooperates with the ratchet 21 of the flange 20 of the actuating rod 19. In use, the spring support 30 axially moves apart from the flange 20 when the actuating rod 19 is rotated in one direction and the teeth of the ratchet 21 of the latter move beyond the teeth of the ratchet 29 of the spring support 30. The ratchets 21 and 29 allow the actuating rod 19 and the tail cap 24 to rotate in one direction only.

FIGS. 4 to 7 show the applicator 1 according to the second embodiment of the present invention. The applicator 1 comprises, similar to the first embodiment, a tubular core 4 having a conduit 6 with an inlet 6*a* and an outlet 7, and an elastic porous outer membrane 5 covering the tip of the tubular core 4. The tip of the tubular core 4 is cut out along a plane 4*a* inclined to the longitudinal axis of the tubular core 4, so that the outlet 7 of the conduit 6 opens on one side of the tubular core 4 from the longitudinal axis thereof. In this case, the outer membrane 5 is made from single porous material in the form of a bag.

Figure 5:
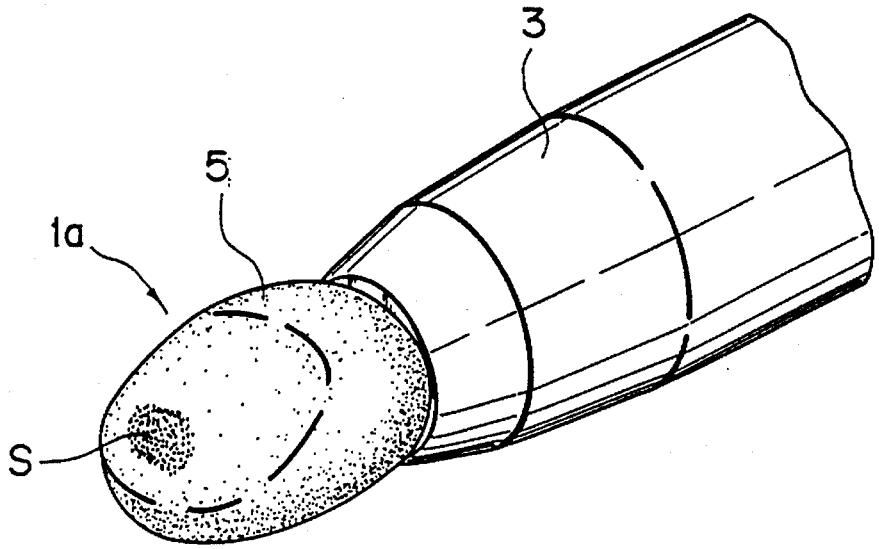
FIG. 5 is a perspective view of the applicator of FIG. 1.
Figure 6:
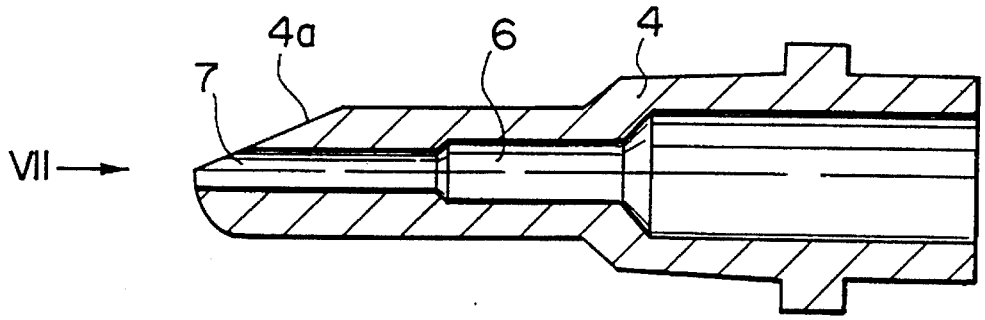
FIG. 6 is a cross-sectional view of the tubular core of FIG. 1.
Figure 7:
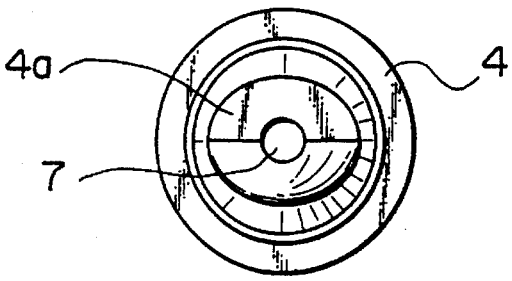
FIG. 7 is a front view of the tubular core of FIG. 6, viewed from the arrow VII in FIG. 6.

The tip portion of the tubular core 4 has a generally oval cross-section with a pair of opposite larger curvature portions and a pair of opposite smaller curvature portions between the larger curvature portions, as shown in FIGS. 5 and 7. The outlet 7 of the conduit 6 opens to one of the larger curvature portions, as shown in FIGS. 6 and 7. Accordingly, a fluid soaks through the outer membrane 5 at the inclined surfaces thereof on one side of the tubular core 4, as indicated by the character S in FIG. 5.

The applicator 1 also includes a reservoir 12 in the main barrel 2, a piston 13, and supporting and actuating members similar to those of FIGS. 1 and 2.

Figure 8:
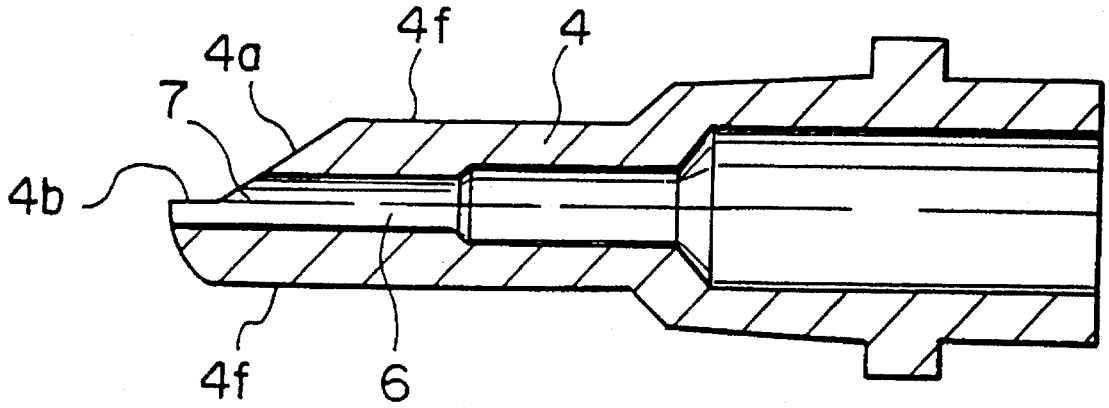
FIG. 8 is a cross-sectional view similar to FIG. 6, but illustrating the tubular core of the first modified example.
Figure 9:
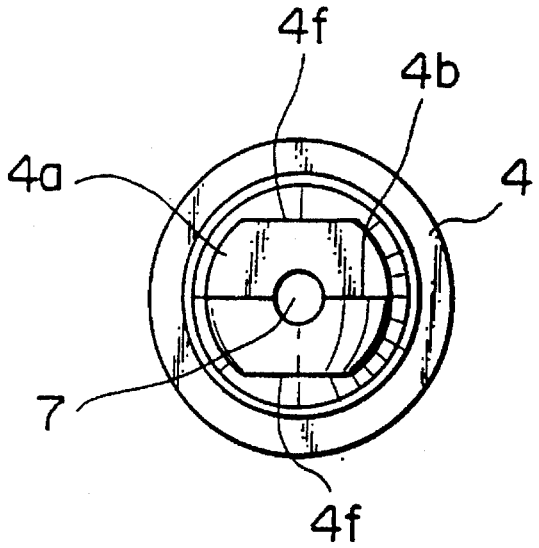
FIG. 9 is a front view of the tubular core of FIG. 8.

In the example shown in FIGS. 8 and 9, the tip portion of the tubular core 4 has a pair of flat outer surfaces 4*f* and the outlet 7 of the conduit 6 opens to one of the flat outer surfaces 4*f*. The conduit 6 extends straight through the tubular core 4, similar to that of the previous embodiment. The tip of the tubular core 4 is cut out along a plane 4*b* passing the longitudinal axis of the tubular core 4, and then along a plane 4*a* inclined to the longitudinal axis of the tubular core 4, to form the outlet 7.

Figure 10:
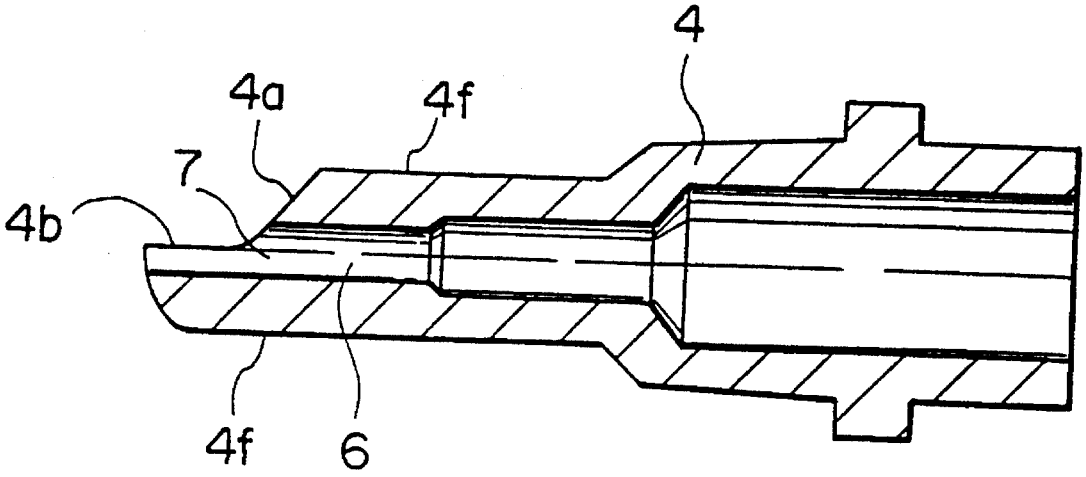
FIG. 10 is a cross-sectional view similar to FIG. 6, but illustrating the tubular core of the second modified example.
Figure 11:
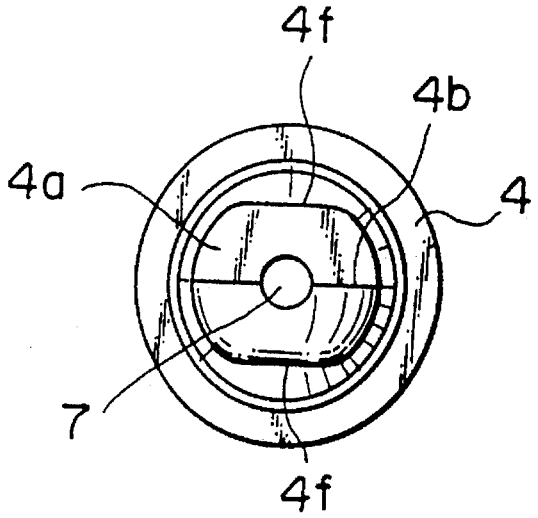
FIG. 11 is a front view of the tubular core of FIG. 10.

In the example shown in FIGS. 10 and 11, the tip portion of the tubular core 4 has a pair of flat outer surfaces 4*f* and the outlet 7 of the conduit 6 opens to one of the flat outer surfaces. The edges of the flat outer surfaces 4*f* are chamfered. The tip of the tubular core 4 is cut out along a plane 4*b* passing the longitudinal axis of the tubular core 4, and then along a plane 4*a* inclined to the longitudinal axis of the tubular core 4, to form the outlet 7. The cut out portion along the plane 4*b* is longer than that of FIGS. 8 and 9.

Figure 12:
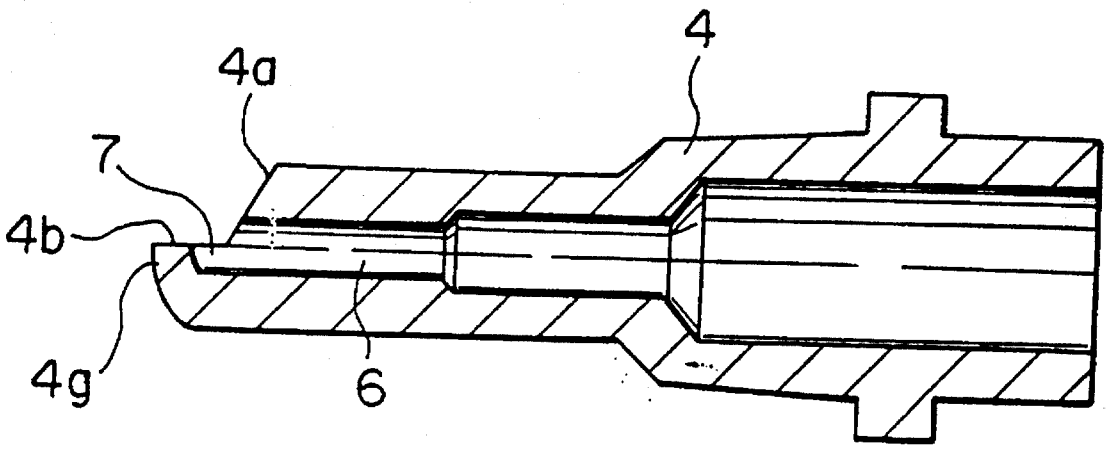
FIG. 12 is a cross-sectional view similar to FIG. 6, but illustrating the tubular core of the third modified example.
Figure 13:
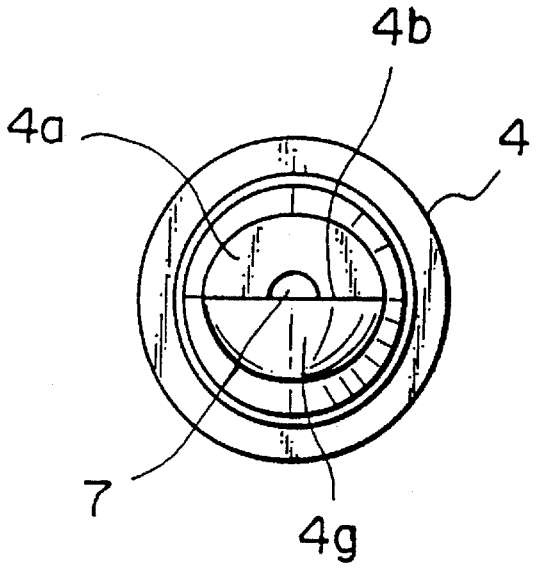
FIG. 13 is a front view of the tubular core of FIG. 12.

In the example shown in FIGS. 12 and 13, the tip portion of the tubular core 4 has an oval profile, similar to that of FIGS. 6 and 7. In this example, a wall 4*g* is provided at a distal end of the tubular core 4 past the outlet 7 to block one half of the conduit 6. The tip of the tubular core 4 is cut out along a plane 4*b* passing the longitudinal axis of the tubular core 4, and then along a plane 4*a* inclined to the longitudinal axis of the tubular core 4, to form the outlet 7.

Figure 14:
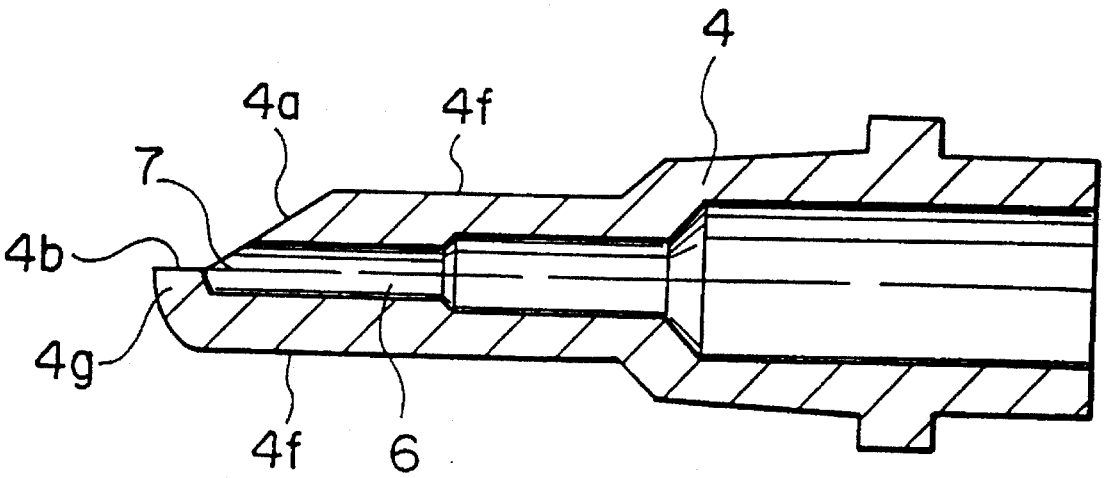
FIG. 14 is a cross-sectional view similar to FIG. 6, but illustrating the tubular core of the fourth modified example.
Figure 15:
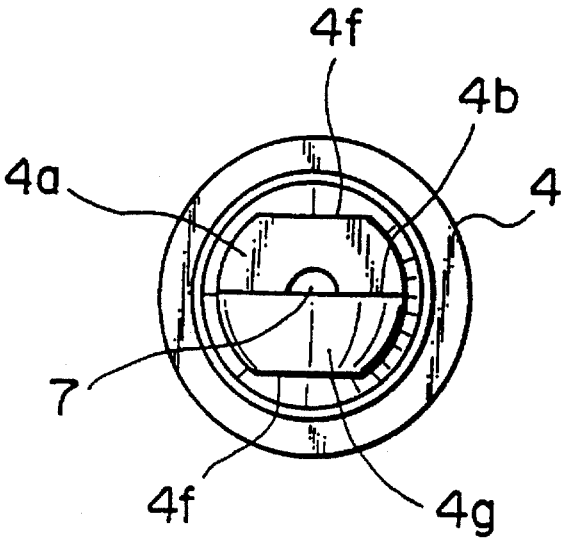
FIG. 15 is a front view of the tubular core of FIG. 14.

In the example shown in FIGS. 14 and 15, the tip portion of the tubular core 4 has a pair of flat surfaces 4*f*, similar to those of FIGS. 8 and 9. In this example, a wall 4*g* is provided at a distal end of the tubular core 4 past the outlet 7 to block one half of the conduit 6. The tip of the tubular core 4 is cut out along a plane 4*a* inclined to the longitudinal axis of the tubular core 4 and passing through the top of the wall 4*g*, to form the outlet 7.

Figure 16:
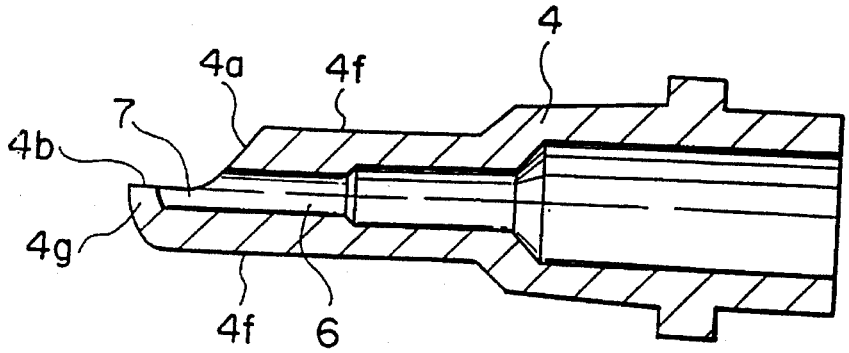
FIG. 16 is a cross-sectional view similar to FIG. 6, but illustrating the tubular core of the fifth modified example.
Figure 17:
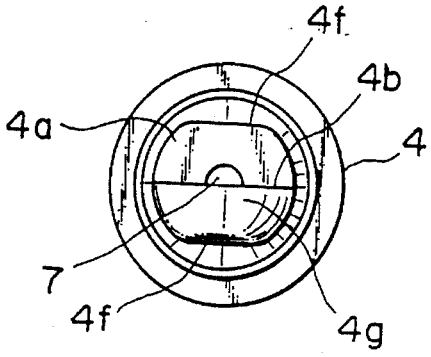
FIG. 17 is a front view of the tubular core of FIG. 16.
Figure 18:
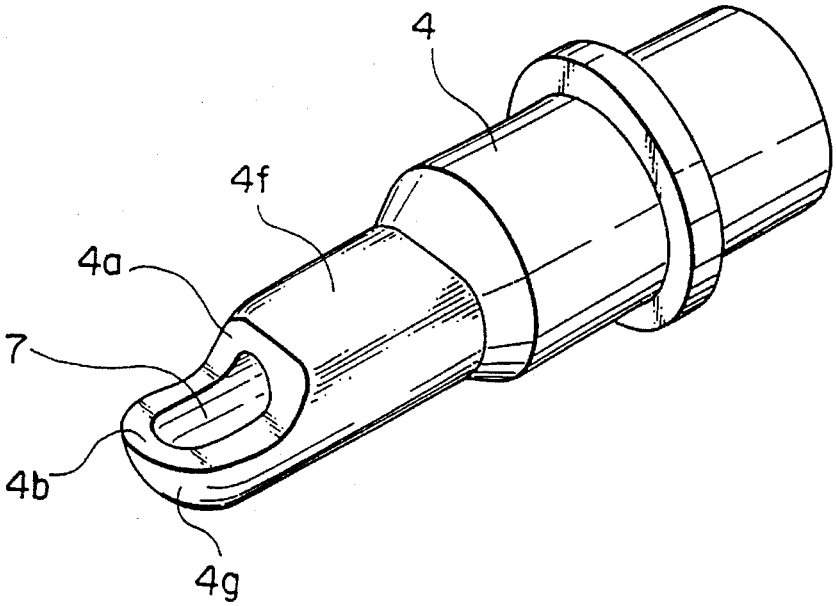
FIG. 18 is a perspective view of the tubular core of FIG. 16.

In the example shown in FIGS. 16 to 18, the tip portion of the tubular core 4 has a pair of flat surfaces 4*f*, similar to those of FIGS. 10 and 11. In this example, a wall 4*g* is provided at a distal end of the tubular core 4 past the outlet 7 to block one half of the conduit 6. The tip of the tubular core 4 is cut out along a plane 4*b* passing the longitudinal axis of the tubular core 4, and then along a plane 4*a* inclined to the longitudinal axis of the tubular core 4, to form the outlet 7.

Figure 19:
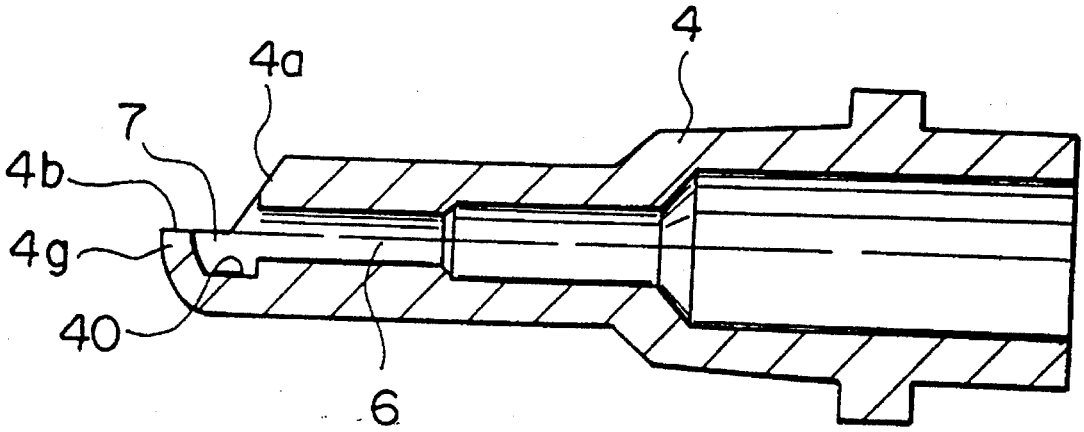
FIG. 19 is a cross-sectional view similar to FIG. 6, but illustrating the tubular core of the sixth modified example.
Figure 20:
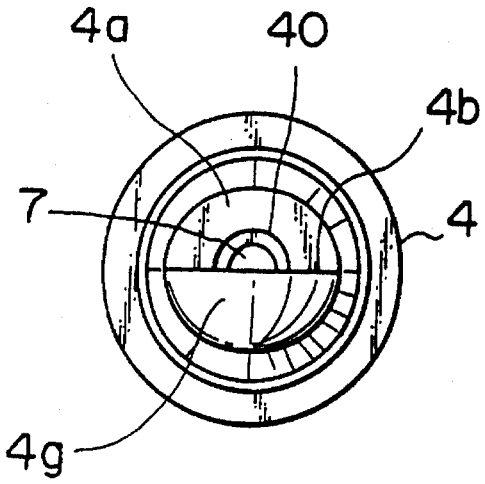
FIG. 20 is a front view of the tubular core of FIG. 19.

FIGS. 19 and 20 shown a further modification. The outer configuration of tubular core 4 is similar to that of FIGS. 12 and 13, but this tubular core 4 has a recess 40 arranged in the conduit 6 of the tubular core 4 near the outlet 7 for holding a fluid therein.

Figure 21:
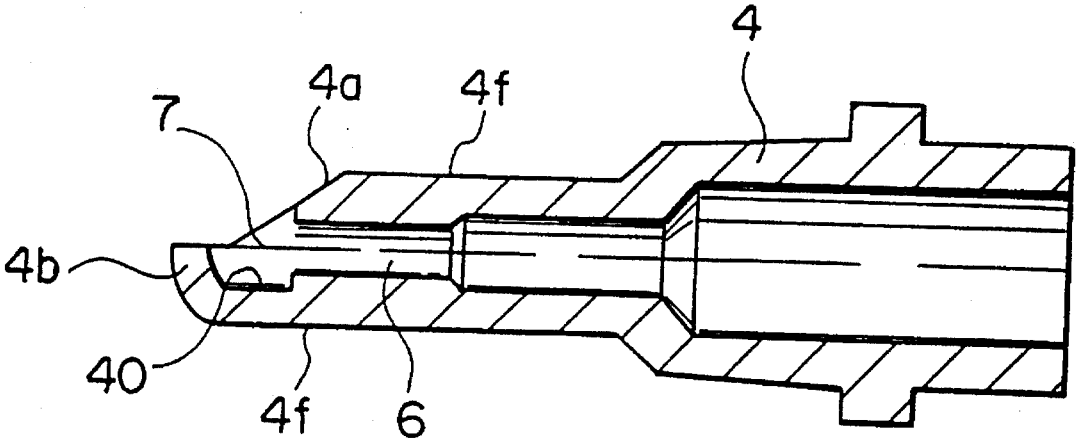
FIG. 21 is a cross-sectional view similar to FIG. 6, but illustrating the tubular core of the seventh modified example.
Figure 22:
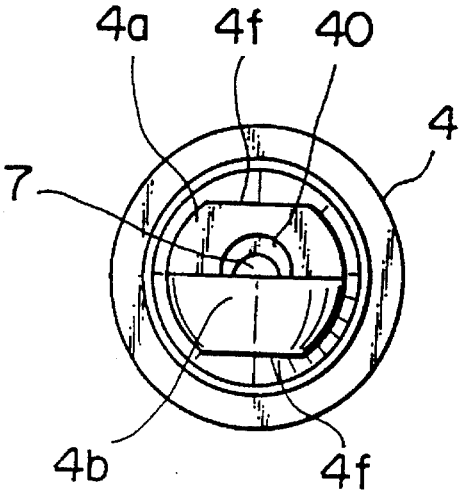
FIG. 22 is a front view of the tubular core of FIG. 21.

In FIGS. 21 and 22, the outer configuration of tubular core 4 is similar to that of FIGS. 14 and 15, but this tubular core 4 has a recess 40 arranged in the conduit 6 of the tubular core 4 near the outlet 7 for holding a fluid therein.

Figure 23:
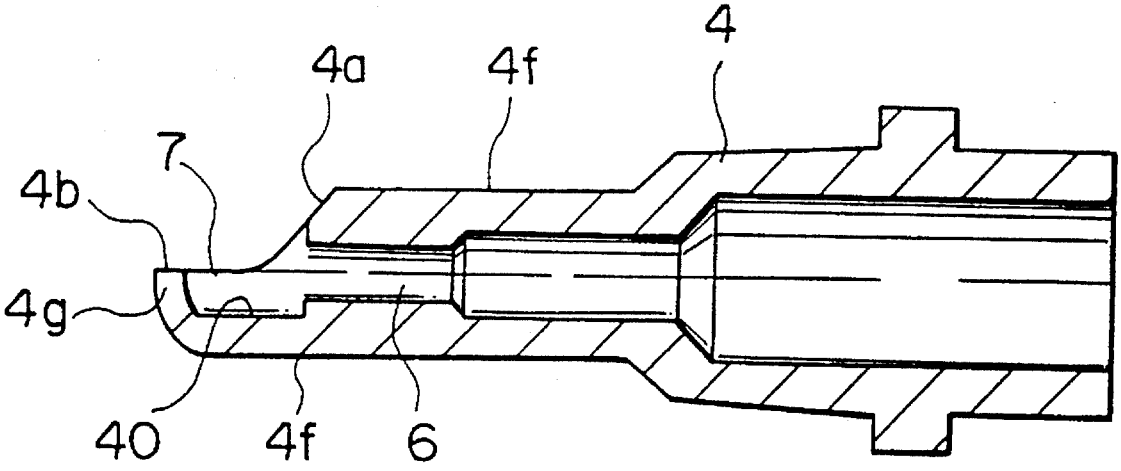
FIG. 23 is a cross-sectional view similar to FIG. 6, but illustrating another tubular core of the seventh modified example.
Figure 24:
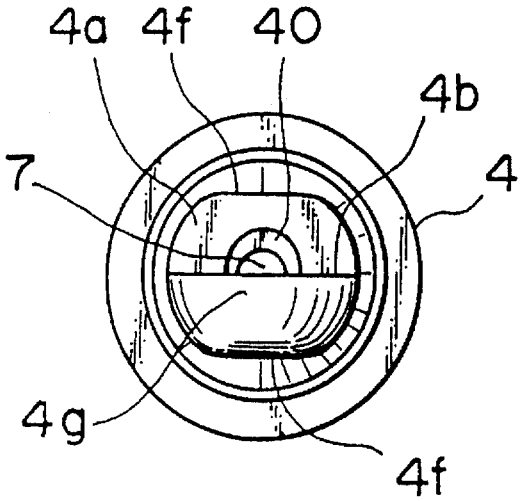
FIG. 24 is a front view of the tubular core of FIG. 23.

In FIGS. 23 and 24, the outer configuration of tubular core 4 is similar to that of FIGS. 16 and 17, but this tubular core 4 has a recess 40 arranged in the conduit 6 of the tubular core 4 near the outlet 7 for holding a fluid therein.

Figure 25:
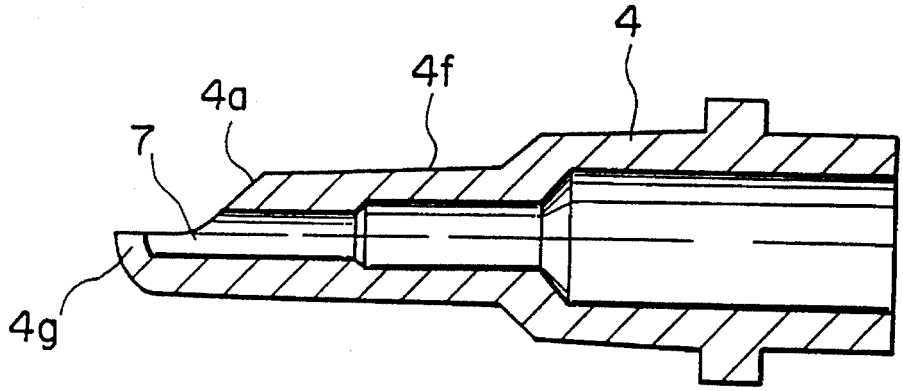
FIG. 25 is a cross-sectional view similar to FIG. 6, but illustrating the tubular core of the eighth modified example.
Figure 26:
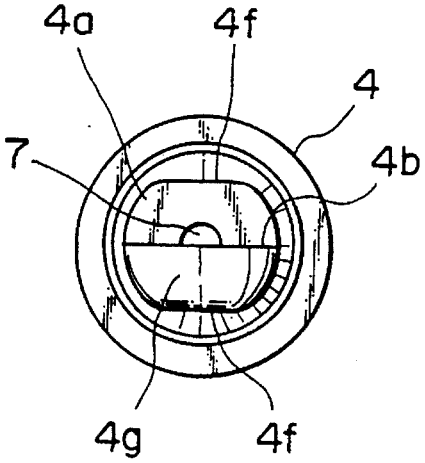
FIG. 26 is a front view of the tubular core of FIG. 25.
Figure 27:
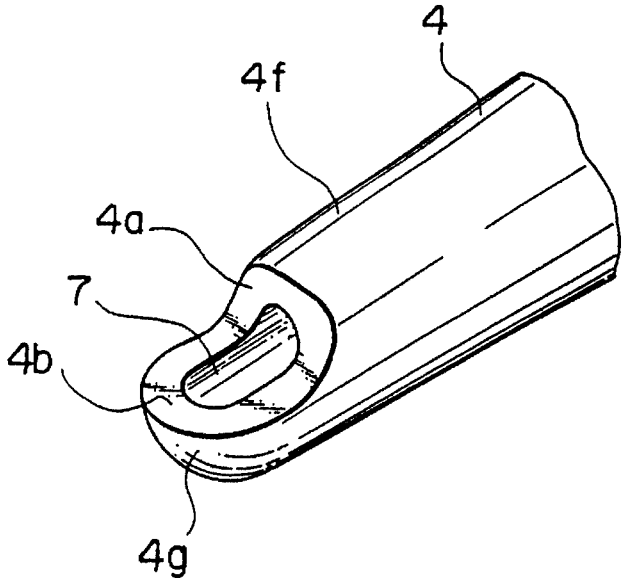
FIG. 27 is a perspective view of the tubular core of FIG. 25.

In FIGS. 25 to 27, the outer configuration of tubular core 4 is generally similar to that of FIGS. 16 and 17, but an outer shape of the tubular core 4 is gradually reduced toward a distal end of the tubular core 4.

Figure 28:
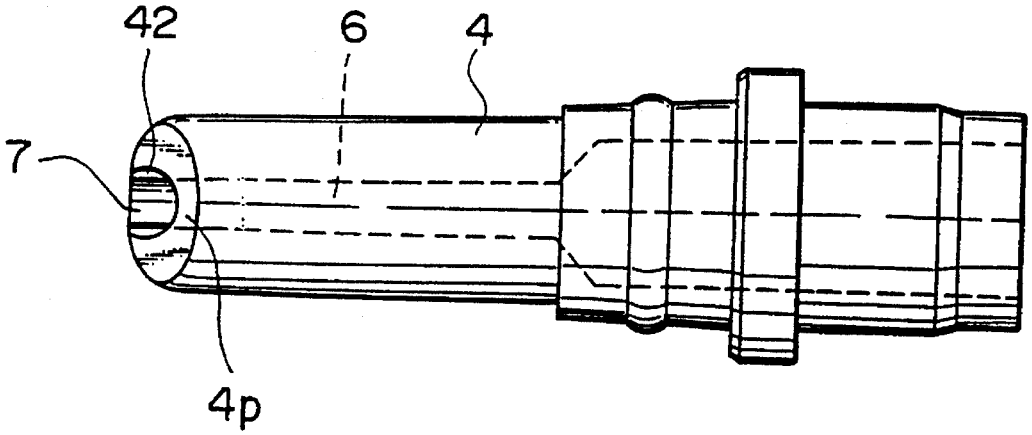
FIG. 28 is a plan view of the tubular core of the ninth modified example.
Figure 29:
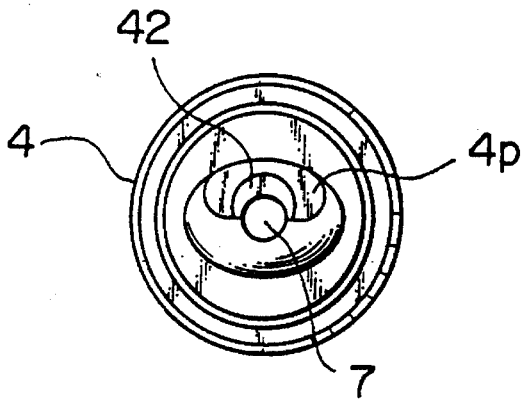
FIG. 29 is a front view of the tubular core of FIG. 28.
Figure 30:
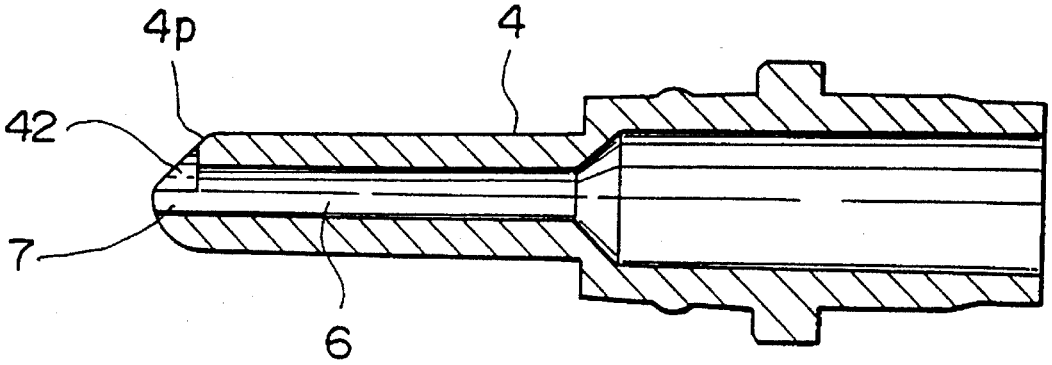
FIG. 30 is a cross-sectional view of the tubular core of FIG. 28.

In FIGS. 28 to 30, the tip of the tubular core 4 is cut out along an inclined surface 4p, and a recess 42 for containing a fluid is provided by drilling the inclined wall in the direction perpendicular to the longitudinal axis of the tubular core 4.

Figure 34:
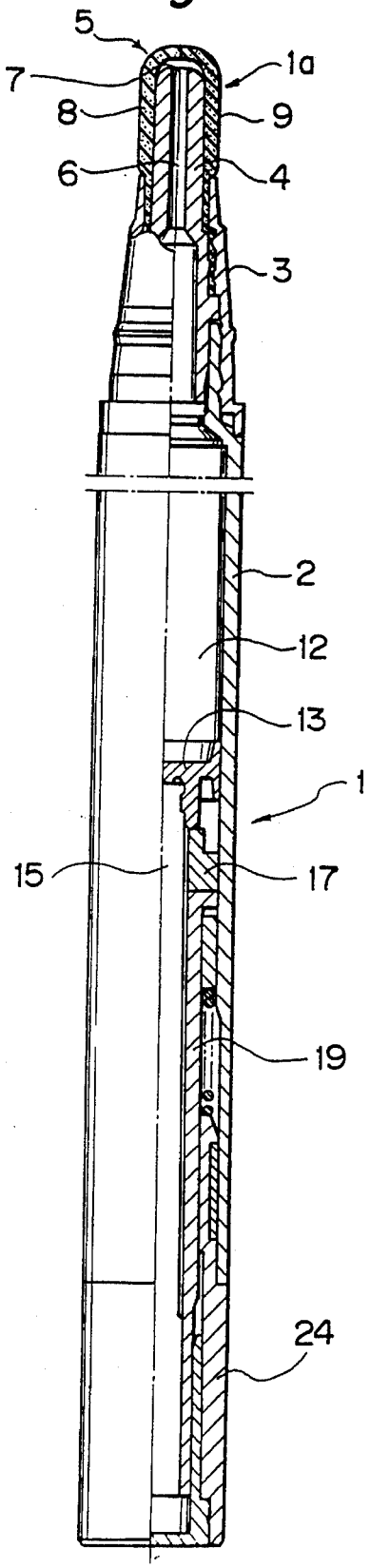
FIG. 34 is a cross-sectional view of the applicator according to the third embodiment of the present invention.
Figure 35:
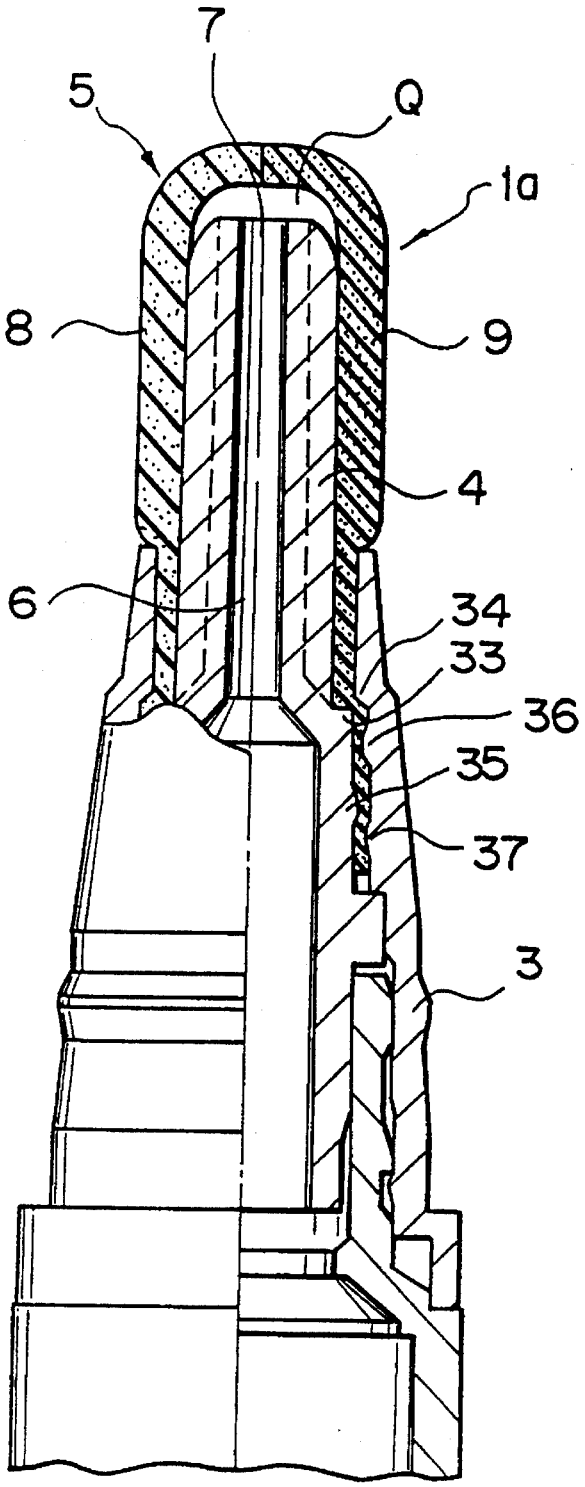
FIG. 35 is an enlarged cross-sectional view of a portion of the applicator of FIG. 34.

FIGS. 34 and 35 show the applicator 1 according to the third embodiment of the present invention. The applicator 1 comprises, similar to the first embodiment, a tubular core 4 having a conduit 6 with an inlet 6*a* and an outlet 7, and an elastic porous outer membrane 5 covering the tip of the tubular core 4. In this case, the conduit 6 extends straight and the outlet 7 is located on the longitudinal axis of the tubular core 4. A space Q is formed between the tip end of the tubular core 4 and the outer membrane 5. The applicator 1 also includes a reservoir 12 in the main barrel 2, a piston 13, and supporting and actuating members similar to those of FIGS. 1 and 2.

The outer membrane 5 comprises porous sheet members 8 and 9. The first porous sheet member 8 comprises a urethane foam having a relatively large porosity with 80 cells/25 mm (the number of cells measured on the line of 25 mm; the brand name: Ever Light SF/HZ), and constitutes one half of the outer membrane 5. The second porous sheet member 9 comprises a urethane foam having a relatively small porosity with 35 cells/25 mm (the brand name: Colorform ECA), and constitute one half of the outer membrane 5. The first and second porous sheet members 8 and 9 are adhered to each other by heating and welding the adjoining portions thereof. The number of the cells represents a fine-grained property of a material, and there is no relationship between the porosity or density and the number of cells. It is possible to make the porous sheet members 8 and 9 from different materials other than urethane foam. For example, silicone sponge, NBR sponge, non-woven fabric, felt, woven fabric and paper can be used.

In this embodiment, a fluid mainly soaks through the first porous sheet member 8 having a relatively large porosity and does not substantially soak through the second porous sheet member 9. Therefore, it is possible to apply a fluid to a skin by using the first porous sheet member 8 of the applicator, and subsequently, to spread and gradate the fluid on the skin by using the second porous sheet member 9 of the applicator.

As a comparative sample for the outer membrane 5, two porous sheet members such as members 8 and 9 are formed from a urethane foam having 60 cells/25 mm (the brand name: Ever Light SF/HQ) and adhered together to constitute a sample outer membrane. This sample outer membrane is incorporated in the applicator 1 with a cream eye shadow having a viscosity of 3,000 centipoise contained in the reservoir 12. When the piston 13 is advanced, the cream eye shadow does not soak through the outer membrane so as much as the case of the above described embodiment, and is accumulated in the space between the outer membrane and the tubular core 4, which results in the expansion of the outer membrane. When the piston 13 is further advanced, the cream eye shadow soaks all around the outer membrane and it is not possible to locate a position where the cream eye shadow mainly soaks. Therefore, it is not possible to spread and gradate the fluid on the skin by using the applicator 1.

Figure 36:
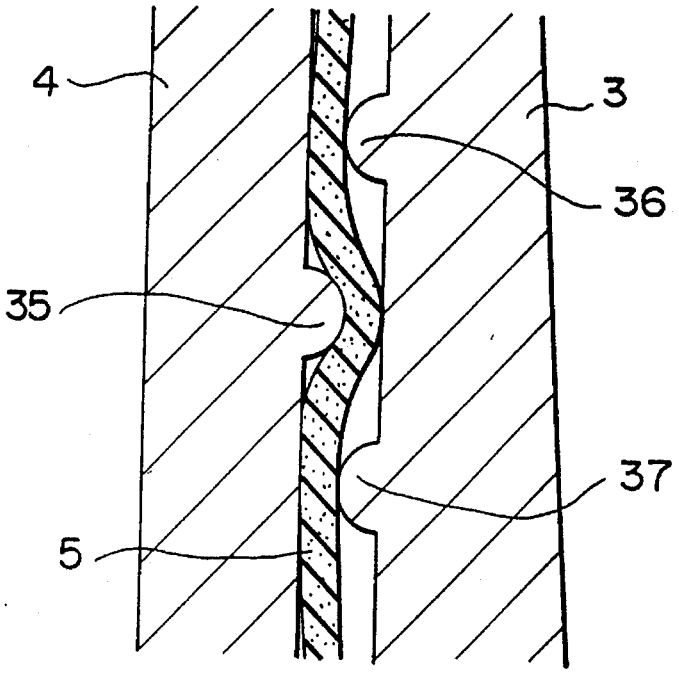
FIG. 36 is an enlarged cross-sectional view of a portion of the applicator of FIG. 35.
Figure 37:
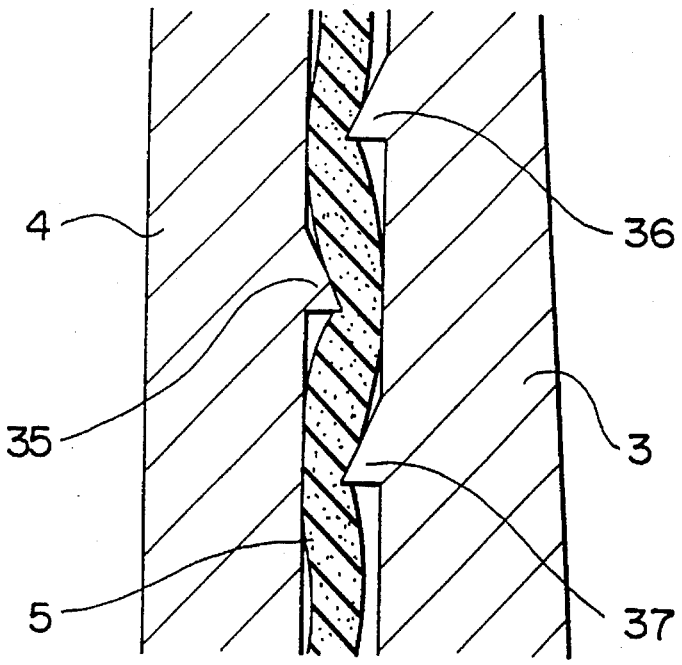
FIG. 37 is a cross-sectional view similar to FIG. 36, but illustrating the modified applicator.

In FIG. 35, the outer membrane 5 is pinched between the annular shoulders 33 and 34 of the tubular core 4 and the end barrel 3, and between the annular projection 35 and the annular projections 36 and 37 of the end barrel 3. The annular projections 35 to 37 have a semi-circular cross-section, as shown in FIG. 36. Alternatively, the annular projections 35 to 37 have a triangular cross-section to reliably secure the outer membrane 5, as shown in FIG. 37.

Figure 38:
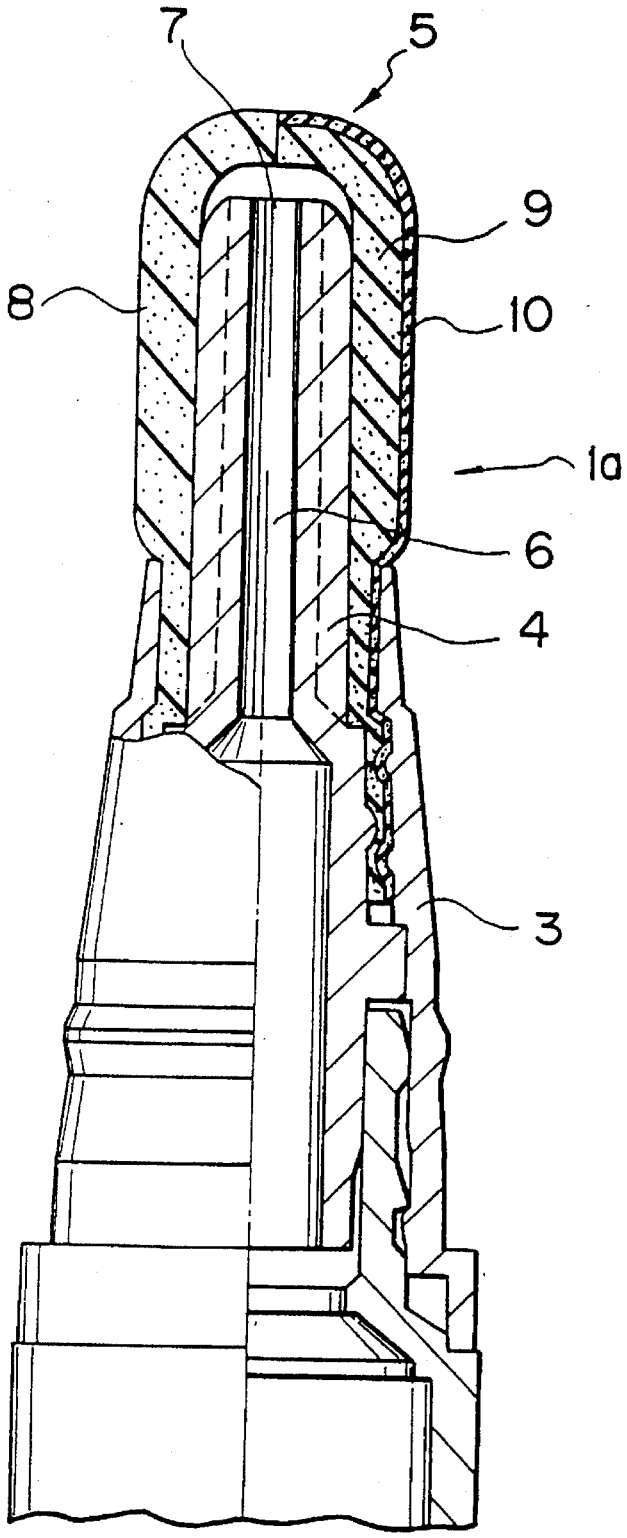
FIG. 38 is a cross-sectional view of the applicator according to the further embodiment of the present invention.

FIG. 38 shows the applicator 1 according to the fourth embodiment of the present invention. The applicator 1 comprises, similar to the third embodiment, a tubular core 4 having a conduit 6 with an inlet **6*a* and an outlet 7, and an elastic porous outer membrane 5. In this embodiment, the outer membrane 5 comprises three porous sheet members 8 to 10. The first porous sheet member 8 comprises a urethane sponge having a relatively large porosity and 40 cells/25 mm. The second porous sheet member 9 comprises a urethane sponge having 80 cells/25 mm, and the third porous sheet member 10 comprises a urethane sponge having 1,000 cells/25 mm. The third porous sheet member 10 overlaps the second porous sheet member 9. The assembly of the second and third porous sheet members 9 and 10 has a relatively small porosity and a relatively large density. Therefore, it is possible to spread and gradate the fluid on the skin with a good feeling by using the third porous sheet member 10** having a fine-grained property.

We claim:

1. An applicator for applying a fluid comprising:

a tubular core having a longitudinal axis, a generally rounded tip, and a conduit extending along the longitudinal axis, the conduit having an inlet adapted to receive a fluid and an outlet; and a porous outer membrane permeable to a fluid and arranged to cover at least a portion of the tubular core including the outlet of the conduit;

wherein the outer membrane includes a small aperture on one side corresponding to the side of the tubular core where the outlet is formed; and wherein the outlet of the conduit of the tubular core is formed by cutting out a portion of the tubular core along a plane inclined to the longitudinal axis so that the outlet opens in the tubular core on one side of the tubular core from the longitudinal axis.

2. An applicator according to claim 1, wherein a recess is arranged in the conduit of the tubular core near the outlet for holding a fluid therein.

3. An applicator according to claim 1, wherein the tubular core has a generally oval cross-section with a pair of opposite larger curvature portions and a pair of opposite smaller curvature portions between the larger curvature portions, and the outlet of the conduit opens to one of the larger curvature portions.

4. An applicator according to claim 1, wherein the tubular core has a pair of flat outer surfaces, and the outlet of the conduit opens to one of the flat outer surfaces.

5. An applicator according to claim 1, wherein the conduit extends straight through the tubular core.

6. An applicator according to claim 1, wherein a wall is provided at a distal end of the tubular core past the outlet to block the conduit.

7. An applicator according to claim 1, wherein an outer shape of the tubular core is gradually reduced toward a distal end of the tubular core.

8. An applicator according to claim 1, further comprising a barrel having a reservoir adapted to contain a fluid therein, wherein the tubular core is attached to the barrel so that the inlet of the conduit receives a fluid in the reservoir.

9. An applicator according to claim 8, further comprising a piston arranged in the reservoir of the barrel, and actuating means for actuating the piston to discharge a fluid in the reservoir through the conduit of the tubular core.

10. An applicator according to claim 9, wherein said actuating means comprise a manually operable member which can be rotatably operated to advance the piston.

11. An applicator according to claim 10, wherein ratchet means are provided to allow the manually operable member to rotate in one direction only.

12. An applicator according to claim 8, wherein the barrel comprises a main barrel and an end barrel attached to the main barrel, the tubular core being attached to the main barrel with the end barrel enclosing the tubular core so that a portion of the outer membrane covering the outlet of the conduit projects from the end barrel.

13. An applicator according to claim 12, wherein the outer membrane is pinched between the tubular core and the end barrel.

14. An applicator according to claim 13, wherein the tubular core has an externally projecting annular shoulder, and the end barrel has an internally projecting annular shoulder arranged in the opposite sense to the externally projecting annular shoulder of the tubular core, whereby the outer membrane is pinched by the externally projecting annular shoulder of the tubular core and the internally projecting annular shoulder of the end barrel.

15. An applicator according to claim 14, wherein the tubular core .has at least one external annular projection, and the end barrel has at least one internal annular projection at a position axially overlapping the at least one external annular projection, whereby the outer membrane is pinched by the at least one external annular projection and the at least one internal annular projection.

16. An applicator according to claim 13, wherein the tubular core has at least one external annular projection, and the end barrel has at least one internal annular projection at a position axially offset from the at least one external annular projection, whereby the outer membrane is pinched in a wavy configuration by the at least one external annular projection and the at least one internal annular projection

17. An applicator according to claim 1, wherein the outer membrane comprises at least two porous sheet members having different porosities from each other.

18. An applicator according to claim 17, wherein one of the at least two porous sheet members having a larger porosity is arranged on one side of the outer membrane to cover the outlet, and the other porous sheet member is arranged on the other side of the outer membrane.

19. An applicator according to claim 17, wherein the at least two porous sheet members comprises three porous sheet members, the first of three porous sheet members is arranged on one side of the outer membrane to cover the outlet, and the second and the third of three porous sheet members are arranged on the other side of the outer membrane with the third porous sheet member covering the second porous sheet member, the third porous sheet member having the smallest porosity.

20. An applicator according to claim 1, wherein the small aperture is formed by piercing a pin in the outer membrane.

21. An applicator according to claim 1, wherein the small aperture is formed by cutting a slit in the outer membrane by a cutter edge.

22. An applicator according to claim 1, wherein the outer membrane comprises at least two porous sheet members having different porosities from each other, one of the at least two porous sheet members having a larger porosity being arranged on one side of the outer membrane to cover the outlet, the other porous sheet member being arranged on the other side of the outer membrane.

23. An applicator according to claim 1, wherein the outer membrane comprises three porous sheet members, the first of three porous sheet members being arranged on one side of the outer membrane to cover the outlet, the second and the third of three porous sheet members being arranged on the other side of the outer membrane with the third porous sheet member covering the second porous sheet member, the third porous sheet member having the smallest porosity.

24. An applicator for applying a fluid comprising:

a tubular core having a longitudinal axis, a generally rounded tip, and a conduit extending along the longitudinal axis, the conduit having an inlet adapted to receive a fluid and an outlet formed by cutting out a portion of the tubular core along a plane inclined to the longitudinal axis; and a porous outer membrane permeable to a fluid and covering at least a portion of the tubular core including the outlet of the conduit, the porous outer membrane comprising at least two porous sheet members having different porosities from each other, one of the at least two porous sheet members having a larger porosity being arranged on one side of the outer membrane from the longitudinal axis of the tubular core, the other porous sheet member being arranged on the other side of the outer membrane; and a small aperture formed in one of the at least two porous sheet members corresponding to the side of the tubular core where the outlet is formed.

25. An applicator according to claim 24, wherein the at least two porous sheet members comprises three porous sheet members, the first of three porous sheet members having a relatively larger porosity being arranged on said one side of the outer membrane to cover the outlet of the conduit, the second and the third of three porous sheet members being arranged on the other side of the outer membrane, the third porous sheet member having a smaller porosity and covering the second porous sheet member.

26. An applicator according to claim 24, wherein a fluid having a viscosity greater than 1,000 centipoise is used.

27. An applicator for applying a fluid comprising:

a tubular core having a longitudinal axis, a generally rounded tip, and a conduit extending along the longitudinal axis, the conduit having an inlet adapted to receive a fluid and an outlet formed by cutting out a portion of the tubular core along a plane inclined to the longitudinal axis; and a porous outer membrane permeable to a fluid and arranged to cover at least a portion of the tubular core including the outlet of the conduit, the outer membrane having a small aperture on one side of the outer membrane from the longitudinal axis of the tubular core.

* * * * *